US005184635A

United States Patent [19]

Tromblee et al.

[11] Patent Number: 5,184,635

[45] Date of Patent: Feb. 9, 1993

[54] FLUID HANDLING SYSTEM FOR A DISHWASHER

[75] Inventors: Jon D. Tromblee, Hagar Township, Berrien County; Vincent P. Gurubatham, St. Joseph; Edward C. Peterson, St. Joseph Township, Berrien County, all of Mich.

[73] Assignee: Whirlpool Corporation, Benton Harbor, Mich.

[21] Appl. No.: 635,488

[22] Filed: Dec. 28, 1990

[51] Int. Cl.[5] ..... B08B 3/02

[52] U.S. Cl. ..... 134/111; 134/115 G; 134/186; 134/200

[58] Field of Search ..... 134/110, 111, 155, 186, 134/115 G, 104.1, 104.4, 200

[56] References Cited

U.S. PATENT DOCUMENTS

| | | | |
|---|---|---|---|
| 935,201 | 9/1909 | Hallauer . | |
| 1,029,541 | 6/1912 | Haustetter | 134/111 X |
| 1,123,260 | 1/1915 | Dusseau . | |
| 1,256,557 | 2/1918 | Heermans . | |
| 1,508,828 | 9/1924 | Wholey | 134/111 X |
| 1,699,618 | 1/1929 | Moses | 366/331 X |
| 1,899,657 | 2/1933 | Zademach | 134/111 X |
| 1,927,665 | 9/1933 | Kirby . | |
| 1,932,827 | 10/1933 | Morris et al. | 134/111 X |
| 1,961,548 | 6/1934 | Caise . | |
| 2,018,757 | 10/1935 | Butterworth . | |
| 2,061,089 | 11/1936 | Rheinstrom . | |
| 2,139,096 | 12/1938 | Piquerez . | |
| 2,235,196 | 3/1941 | Bilde . | |
| 2,314,332 | 3/1943 | Ferris . | |
| 2,421,064 | 5/1947 | Hilliker | 134/115 G |
| 2,561,631 | 7/1951 | Negri | 134/111 X |
| 2,619,099 | 11/1952 | Young . | |
| 2,621,666 | 12/1952 | Hoirt AF Ornas . | |
| 2,681,658 | 6/1954 | Meeker et al. . | |
| 2,704,082 | 3/1955 | Jackson | 134/111 X |
| 2,714,354 | 8/1955 | Farrand . | |
| 2,742,381 | 4/1956 | Weiss et al. . | |
| 2,779,052 | 1/1957 | Zebarth . | |
| 2,802,477 | 8/1957 | Levit . | |
| 2,813,534 | 11/1957 | Low . | |
| 2,845,936 | 8/1958 | Boynton et al. . | |
| 2,862,510 | 12/1958 | Geiger et al. . | |
| 2,894,631 | 7/1959 | Levit et al. | 134/111 X |
| 2,907,335 | 10/1959 | Abresch . | |
| 3,034,518 | 5/1962 | Butsch et al. . | |
| 3,051,184 | 8/1962 | Gibson . | |
| 3,072,128 | 1/1963 | James . | |
| 3,084,701 | 4/1963 | Hardy et al. . | |
| 3,106,930 | 10/1963 | James . | |
| 3,111,132 | 11/1963 | James . | |
| 3,126,025 | 3/1964 | Aubert et al. . | |
| 3,129,711 | 4/1964 | Schmitt-Matzen . | |
| 3,370,598 | 2/1968 | Lopp et al. . | |
| 3,434,671 | 3/1969 | Cushing et al. . | |
| 3,457,929 | 7/1969 | Madden . | |
| 3,465,761 | 9/1969 | Meeker et al. . | |

(List continued on next page.)

FOREIGN PATENT DOCUMENTS

| | | | |
|---|---|---|---|
| 52-41466 | 3/1977 | China . | |
| 917468 | 9/1954 | Fed. Rep. of Germany . | |
| 1933543 | 1/1971 | Fed. Rep. of Germany | 134/111 |
| 2513621 | 12/1975 | Fed. Rep. of Germany . | |
| 1293779 | 4/1962 | France . | |
| 568345 | 3/1945 | United Kingdom . | |
| 1202546 | 8/1970 | United Kingdom | 134/111 |

*Primary Examiner*—Frankie L. Stinson
*Attorney, Agent, or Firm*—Hill, Steadman & Simpson

[57] ABSTRACT

A dishwasher is provided with a fluid handling system that utilizes two separate sumps and two separate pumps. A first sump receives a portion of the wash liquid from the wash chamber and recirculates the wash liquid by use of a relatively high capacity pump in the first sump. The second sump receives the remainder of the wash liquid and removes both heavier-than-water and lighter-than-water soils before directing this remainder of the wash liquid to the first sump. A relatively low capacity pump in the second sump directs wash liquid and collected soils to an exterior drain.

20 Claims, 4 Drawing Sheets

U.S. PATENT DOCUMENTS 3,669,132 6/1972 Mamrose ..... 134/104.4 X
3,973,866 8/1976 Vaughan .
3,981,456 9/1976 Hahn et al. .
3,989,054 11/1976 Mercer ..... 134/104.4 X
4,038,103 7/1977 Grunewald .
4,088,145 5/1978 Noren .
4,143,993 3/1979 Blum .
4,150,679 4/1979 Cushing et al. .
4,150,680 4/1979 Johnson et al. .
4,168,715 9/1979 Spiegel et al. .
4,201,345 5/1980 Ziegler .
4,319,599 3/1982 Dingler et al. .
4,378,214 3/1983 Keener .
4,430,214 2/1984 Baker .
4,776,359 10/1988 Federighi, Jr. et al. .
4,781,206 11/1988 Noren .
4,795,102 1/1989 Jordan et al. .
4,833,900 5/1989 Babuin et al. ..... 134/111 X
4,844,106 7/1989 Hunter et al. .
4,848,382 7/1989 Bertsch et al. .
4,972,861 11/1990 Milocco et al. ..... 134/111 X
4,998,548 3/1991 Lagerstrand ..... 134/111

FLUID HANDLING SYSTEM FOR A DISHWASHER

BACKGROUND OF THE INVENTION

This invention relates to a fluid handling system for a dishwasher, and more particularly to a fluid handling system for a countertop dishwasher.

Fluid handling systems for dishwashers are known. U.S. Pat. No. 2,621,666 discloses a dishwashing machine which utilizes two separated chambers for containing washing fluid and rinsing fluid, respectively. The fluid is pumped into the wash chamber at appropriate times by the wash pump and the rinse pump. Water is drained from the dishwasher trough water vessel by siphon.

U.S Pat. No. 4,776,359 discloses a glass-washing machine having a control module which includes a pump-/motor assembly disposed in a sump. A drain valve solenoid operates a drain valve for draining the sump at the appropriate time.

U.S Pat. No. 4,150,680, assigned to the assignee of the present invention, discloses a dishwasher which includes a single pump which acts both as a wash pump and a drain pump.

U.S. Pat. No. 3,457,929, assigned to the assignee of the present invention, discloses a dishwasher which, in the modified form shown in FIG. 2, includes a spray pump which circulates dishwashing liquid from sump to the tub. Liquid returns to the sump to be recirculated through a foraminous wall, with food particles retained in a funnel to be pumped out at the end of a wash cycle by a drain pump.

Dishwashers having fluid handling systems including sumps for collection of water draining from the wash cavity are well known in the prior art. A typical fluid handling system includes a single wash pump which operates in a sump to recirculate water within the wash cavity ('359 noted above), or a single pump which operates to recirculate water within the wash cavity and to pump water out of the sump ('680 noted above). Another handling system includes a pump which operates in a sump to recirculate water within the wash cavity, and a drain pump which operates in the same sump to pump water out of this sump ('929 noted above).

A disadvantage of such systems is that they are incapable of operating on separate sumps which receive water from the wash cavity and which contain wash or rinse water in various states of filtration. Among further disadvantages, particularly to a fluid handling systems using a single pump, is the use of a pump of unnecessarily high capacity to drain the sump, which wastes energy and requires additional expense to provide either the controls or valves necessary to provide both a wash and a drain function.

Yet another fluid handling system ('666 noted above) includes a wash pump which operates in a sump to provide wash water to a spray arm for distribution in the wash cavity, and a rinse pump which operates in a sump to provide rinse water to a spray pipe for distribution in a wash cavity. All water draining from the wash cavity enters the wash pump sump whereupon, when the water reaches a given level in the sump, a siphon tube drains the water from the wash pump sump. A disadvantage of such a system is that the wash pump sump is not drainable to a water level higher than that in the wash pump sump. Furthermore, draining is less controllable than with a drain pump, since it is a function of water height in the wash sump pump rather than a switchable drain pump.

SUMMARY OF THE INVENTION

The present invention provides an improved fluid handling system for a dishwasher. An object of the invention is to provide a fluid handling system for a dishwasher which uses a first relatively large-capacity pump to provide pressurized wash fluid to a spray arm for distribution within a wash chamber, and a second relatively small-capacity pump for pumping soil-laden water from the dishwasher. Another object of the invention is to provide a relatively small-capacity pump for pumping soil-laden water from the dishwasher, which includes a soft-soil chopper for reducing the size of food particles before they are pumped from the dishwasher. Yet a further object of the invention is to provide, in the fluid handling system, pumps which are capable of running dry for extended periods without harm to the dishwasher or the pumps. Other objects of the invention will be evident from the description of the invention set forth herein.

The disclosed structure embodying the principles of the present invention overcomes the disadvantages of prior art dishwashers by utilizing a first relatively large-capacity pump to provide pressurized wash fluid to a spray arm for distribution within a wash chamber, and a second relatively small-capacity pump for pumping soil-laden water from the dishwasher, each pump being positioned in its own, separate sump. Accordingly, an appropriate capacity pump is used for each task. Another advantage is the ability, in a compact dishwasher, to drain soil-laden water from the dishwasher to a level higher than a sump. Another advantage of the invention is to use a relatively small capacity pump for pumping soil-laden fluid from the dishwasher, which includes a soft-soil chopper for reducing the size of food particles before they are pumped from the dishwasher. Yet a further advantage of the invention is to use, in the fluid handling system, pumps which are capable of running dry for extended periods without harm to the dishwasher or the pumps.

The dishwasher embodying the principles of the present invention is sized to fit on the kitchen countertops of most homes, under existing standard overhead cabinets. It could be built as a free-standing unit but could also be built as a built-in unit. The dish rack is designed to hold at least four complete place settings.

DESCRIPTION OF THE PREFERRED EMBODIMENTS

Figure 1:
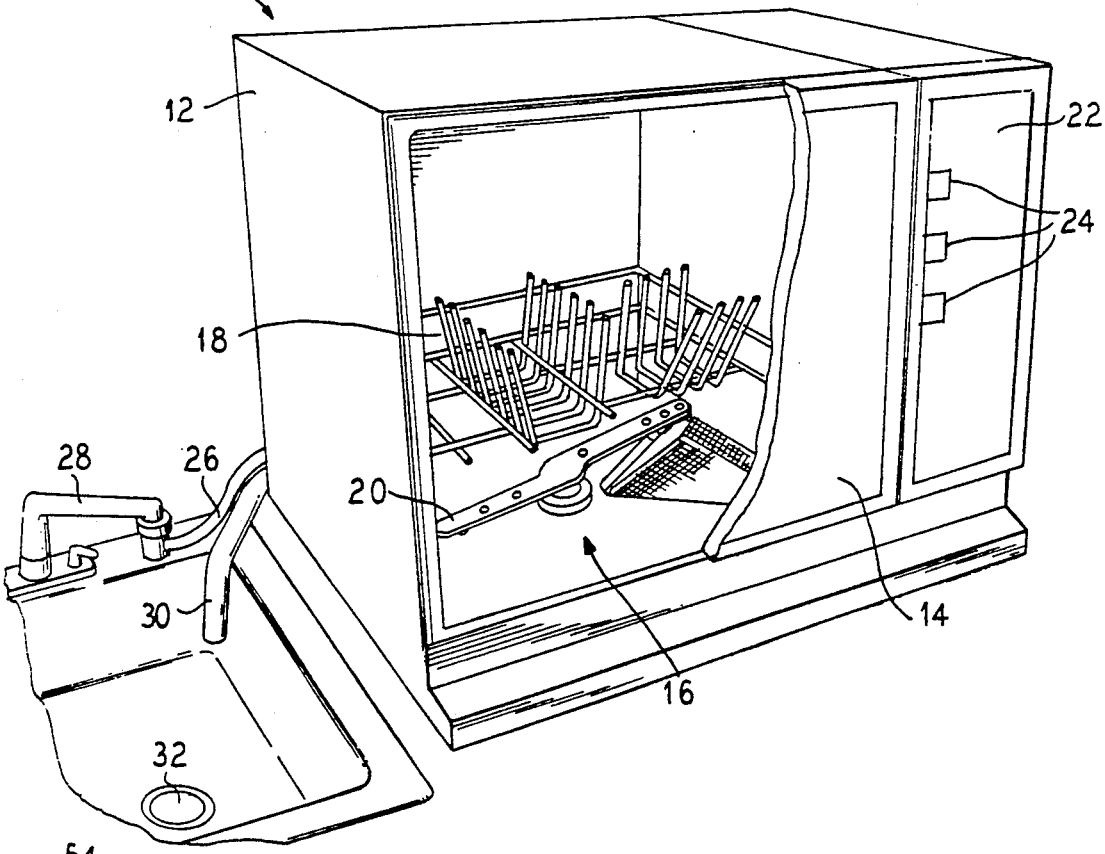
FIG. 1 is a perspective view of an automatic dishwasher incorporating the principles of the present invention.

FIG. 1 shows a dishwasher 10 having a cabinet 12 and an openable door 14. A wash chamber 16 of the cabinet 12 houses dish supporting racks 18 and a rotating spray arm 20.

A control panel 22 is provided with a plurality of controls 24 for pre-selecting the desired cycle of operation for the dishwasher.

Since the dishwasher 10 embodying the principles of the present invention may be a countertop style dishwasher, a water inlet hose 26 is shown as being connected to a kitchen faucet 28 and a drain hose 30 is shown as being directed toward a kitchen sink drain 32. Of course, the dishwasher 10 could be a built-in unit, in which case the water inlet line 26 and the drain line 30 would be permanently connected to the house plumbing.

As seen in FIG. 1, there is a dish rack 18 provided in the dishwasher. The rack may be provided with rollers 33 (FIGS. 5 and 6) for easy movement of the rack. Preferably, the rack is formed of welded wire with a plastic coating. The wire form of the dish rack is designed so as to minimize interference of the rack with spray from the spray arm 20.

Figure 2:
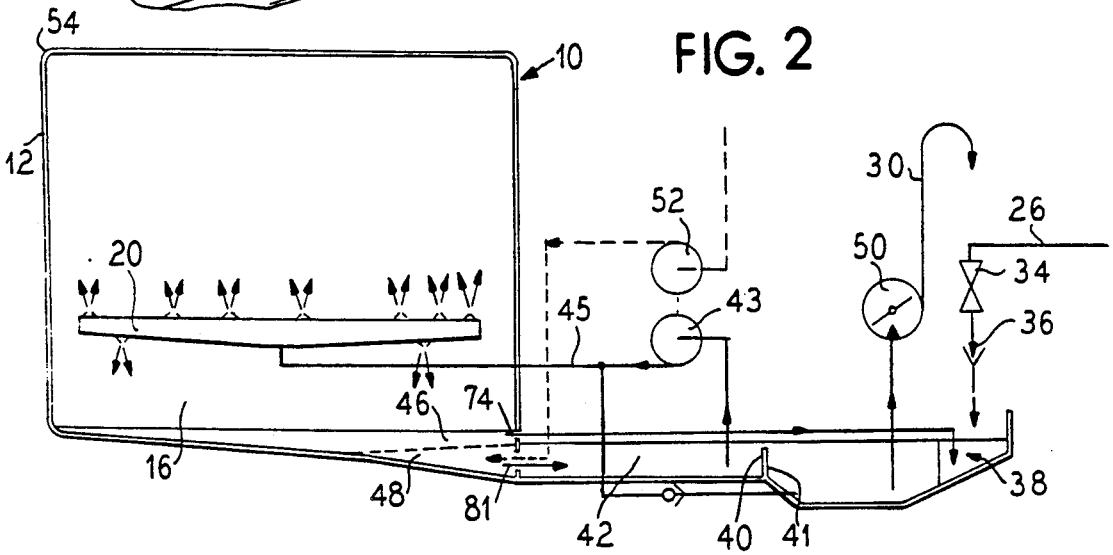
FIG. 2 is a schematic illustration of the fluid flow patterns through the dishwasher of FIG. 1.

FIG. 2 shows a schematic illustration of the fluid flow patterns within the dishwasher 10. In the schematic illustration the water inlet line 26 is shown at the far right, where it is seen that water first passes through a fill valve 34 which is operated by the dishwasher control 24. The inlet water then passes through a vacuum break 36 and into a settling chamber/drain sump 38. From the settling chamber/drain sump 38, water flows through an opening 40 in a separating wall 41 into a spray sump 42. From the spray sump 42 water is drawn by a spray pump 43 driven by a motor 44 (FIG. 4) and directed to the spray arm 20 within the wash chamber 16 through a connecting conduit 45. Water from the wash chamber 16 partially flows to a first trough 46 into the settling chamber/drain sump 38 and partially to a second trough 48, through an opening 81 and back to the spray sump 42. At various times during the wash cycle, when it is desired that the wash liquid be removed from the dishwasher, a drain pump 50 driven by a motor 51 (FIG. 4) draws wash liquid from the settling chamber/drain sump 38 and directs it to the drain line 30.

During a drying portion of the wash cycle, room air is drawn in by a blower or fan 52 operated by the spray pump motor 44. The air is directed in through the second trough 48 to flow through the wash chamber 16 to be vented through an opening 54 preferably located near the front top portion of the dishwasher cabinet 12.

Figure 3:
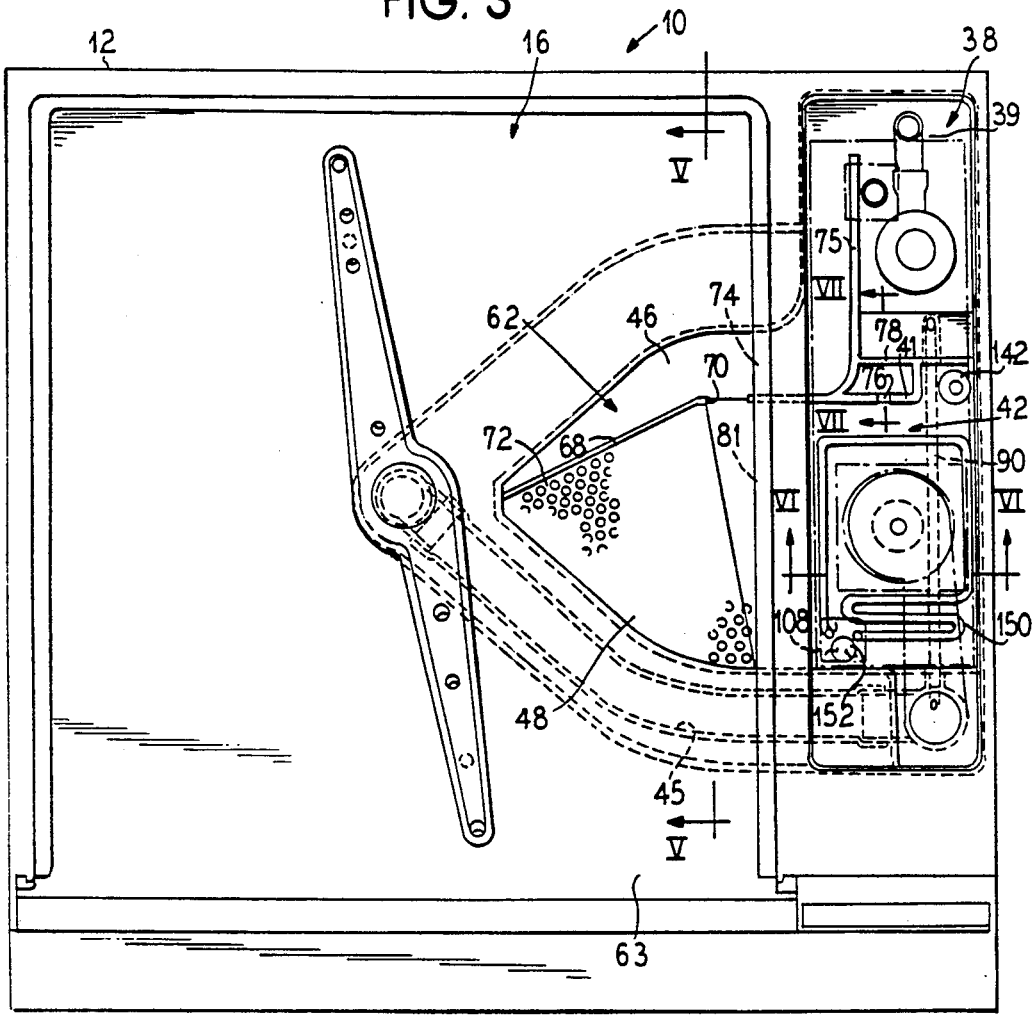
FIG. 3 is a plan view of the base portion of the dishwasher of FIG. 1.
Figure 5:
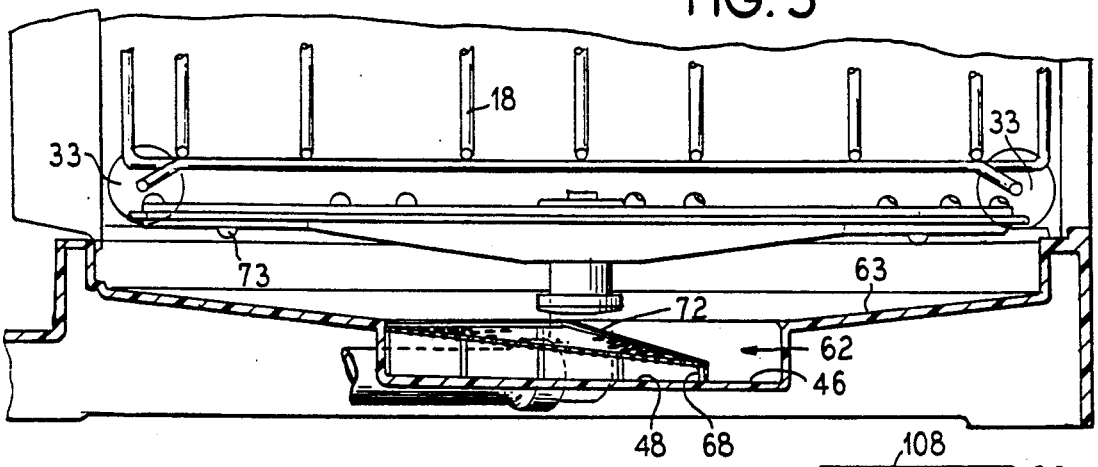
FIG. 5 is a side sectional view of the wash cavity and sump inlet areas taken generally along the line V—V of FIG. 3.
Figure 6:
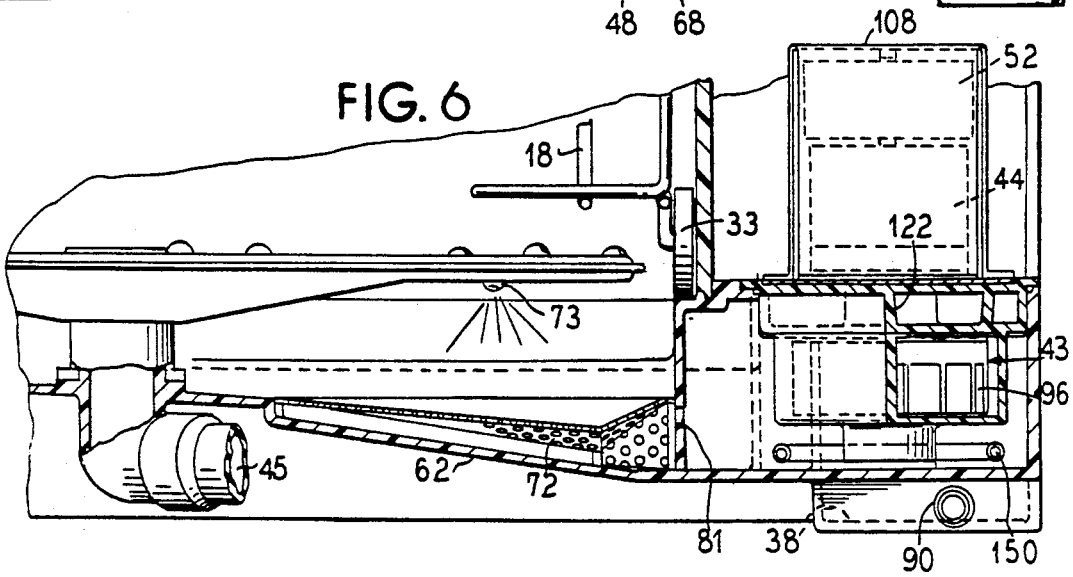
FIG. 6 is a side sectional view of the wash cavity and sump inlet areas taken generally along the line VI—VI of FIG. 3.

As best seen in FIGS. 3 and 5, wash liquid drains from the wash cavity 16 by means of a depressed area or sump 62 which preferably is molded into a bottom wall 63 of the wash chamber. The depressed area 62 is divided into the two troughs 46, 48 by a dividing wall 68 which extends along most, but not the entire length of the depressed area 62. There is a communicating opening 70 through the wall 68 between the two troughs 46, 48 which assists in the draining of the dishwasher. The two troughs are of unequal size, and the larger trough 48 leads to the spray sump 42, and is covered with a filter screen 72 which permits passage of liquid, but which inhibits passage of food particles.

The screen 72 is sloped downwardly toward the smaller trough 46, and thereby assists in the movement of soil particles toward the first trough.

Also, the spray arm 20 has at least one downwardly directed nozzle opening 73 which directs a spray of wash liquid against the screen 72 (FIG. 6) to assist in the cleaning of the screen and directing food particles to the first trough 46. Spray arm rotation is set so that the cleaning spray can sweep soil directly off of the filter screen 72 and into the first trough 46 leading to the settling chamber/drain sump 38. The first trough 46 leads to an opening 74 communicating with the settling chamber/drain sump 38 which is located at the lowest elevation of the dishwasher cabinet.

The settling chamber/drain sump 38 is crucial to the operation of the dishwasher, in that it enables the dishwasher to achieve an acceptable level of wash results with just four fills and one detergent addition. The settling chamber/drain sump 38 removes both lighter-than-water and heavier-than-water soils from the recirculating wash liquid. These soils are trapped in the settling chamber/drain sump 38, in which the drain pump 50 is located, so that they are disposed of quickly during the pump-out process. The settling chamber/drain sump 38 includes an isolated chamber 39 to which soil-laden water is directed from the trough 46 in the dishwasher base unit. The entry opening 74 to the settling chamber/drain sump 38 has its top 74*a* above the operating wash liquid level. This allows floating soil to enter the chamber and prevents it from being trapped in the main washing compartment 16.

Figure 7:
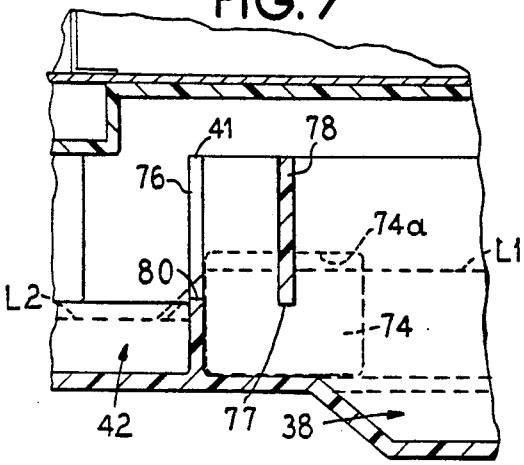
FIG. 7 is a side sectional view of the sumps separating wall taken generally along the line VII—VII of FIG. 3.
Figure 8:
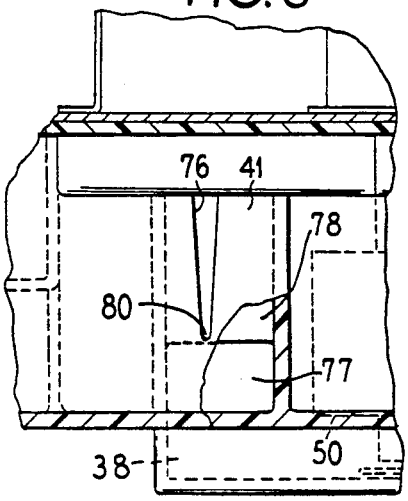
FIG. 8 is a side sectional view in the spray sump taken generally along the line VIII—VIII of FIG. 9.

The flow through the settling chamber/drain sump 38 is carefully controlled to reduce turbulence and allow soils to settle (or float) out of the wash/rinse fluid. Within the settling chamber/drain sump 38 there is a baffle wall 75 which prevents turbid fluid from the wash chamber 16 from flowing directly into the isolated chamber 39. During the wash cycle, as fluid flows through the trough 46 into the settling chamber/drain sump 38, it is permitted to flow then into the spray sump 42 through the opening 76, which is in the form of a V-shaped notch (FIGS. 3,7 and 8) formed in the wall 41 that isolates the settling chamber/drain sump from the spray sump.

The V-notch 76 is sized so that a flow rate of approximately one-half gallon per minute is maintained through the V-notch when the spray pump 43 is operating. The flow of wash liquid from the settling chamber/drain sump 38 to the spray sump 42 is directed through an opening 77 (FIGS. 7,8) under an appropriately spaced wall 78 so that floating soil is trapped in the settling chamber/spray sump before it gets to the V-notch 40. A bottom 80 of the V-notch 40 is high enough to trap heavy soil that has settled to the bottom of the isolated chamber 39. The flow velocity through the settling chamber/drain sump 38 is normally relatively slow, thus allowing heavier-than-water soils to settle, and lighter-than-water soils to rise.

The screen 72 provides a small impedance of the flow of wash liquid from the wash cavity sump 62, through an opening 81 communicating with the spray sump 42.

This impedance produces a wash liquid level that is higher in the settling chamber/drain sump 38 than the level in the spray sump 42, and provides the driving force that gives the above-mentioned one-half gallon per minute separator flow.

The system described is self-regulating. In the exemplary embodiment, the settling chamber/drain sump 38 is designed for a one-half gallon per minute flow of relatively clean wash liquid. When heavy soils are encountered, the protecting filter screen 72 may become partially blocked. This increases the flow impedance to the spray pump 43 and creates a greater fluid level difference between the spray sump 42 and the isolated chamber 39 of the settling chamber/drain sump 38. As the fluid level in the spray sump 42 drops the effective fluid passage area through the V-notch 40 increases. The result is that the fluid flow rate through the V-notch 40 increases until the heavy soil is pulled from the surface of the screen 72 and into the settling chamber/-drain sump.

As a result, the filter screen blockage has been eliminated, flow impedance is returned to normal, and then flow through the settling chamber/drain sump returns to the one-half gallon per minute rate. The result is very rapid removal of large soil particles from the wash water followed by removal of the fine soil particles. The slow relatively turbulence-free flow through the settling chamber/drain sump 38 also minimizes the suspension and homogenizing action that occur between detergent and soil in a highly agitated system. The result is that little detergent is used by the soil trapped in the settling chamber/drain sump 38. This means that more detergent remains available in the water for cleaning of the dishes, or, alternatively, less detergent addition is needed to perform the cleaning function.

At appropriate times during the wash cycle the wash liquid within the dishwasher is pumped by drain pump 50 through the drain line 30 to remove wash liquid and collected soil particles from the dishwasher. A soil chopper 82 (FIG. 4), including a single wire pressed at a right angle through an extension 84 of the pump impeller, is located just below an impeller opening 86 of the drain pump 50. The proximity of the chopper 82 to the impeller opening 86 is chosen such that the chopper 82 chops all soil to a size that can pass through both the pump 50 and the drain hose 30 of the system. A pump capacity of approximately one gallon per minute has been determined to be sufficiently large to provide the necessary pump out operation.

A separate drain line 90 (FIG. 4) is provided between the spray conduit 45 and the drain pump 50 to permit a pump out of all wash liquid within the system. The drain line 90 includes a check valve 92 which is closed when the spray pump 43 is in operation, but which moves to an open position, allowing draining to the settling chamber/drain sump 38, when the spray pump 43 is not in operation.

Both the spray pump 43 and drain pump 50 of the power system are designed to operate without pump seals. This is facilitated by the fact that both of the motors are well above the operating wash liquid level. To facilitate the no-seal design, impellers 94, 96 of the pumps 50, 43 have pumping elements or impeller blades 98, 100 on both sides. The pumping element 100 on the motor side of the impeller counteracts the pressure developed by the main impeller pumping element 98. This prevents pressurized water from escaping through a clearance space 102 between a motor shaft 104 and the pump body 106. This design eliminates both manufacturing and service costs associated with pump seals. It also allows the pumps to be run "dry" with no chance for seal damage.

Since running dry is possible, the spray pump motor 44 is fitted with the fan 52 that serves both to cool the motor and to provide forced air for drying within the dishwasher. A cover 108 is provided which surrounds the motors 44, 51 and fan 52, and which is secured to a subassembly base 110 carrying the motors 44, 51 by an appropriate fastener arrangement such as a tab in groove connection 112 at one end 114 and a wire rod clip 116 secured between the cover 108 and the dishwasher base 118 at an opposite end 120.

The subassembly base 110 has a passage 122 molded therein which permits air from outside the cover 108 to be drawn into an area 124 enclosed by the cover 108. More particularly, the air is drawn through the passage 122 into openings 126 which are within a separate cover 128 enclosing the motor 44. The air is then drawn through an opening 130 in the motor cover 128 into the fan 52 which then pressurizes the area 124 within the cover 108.

Figure 9:
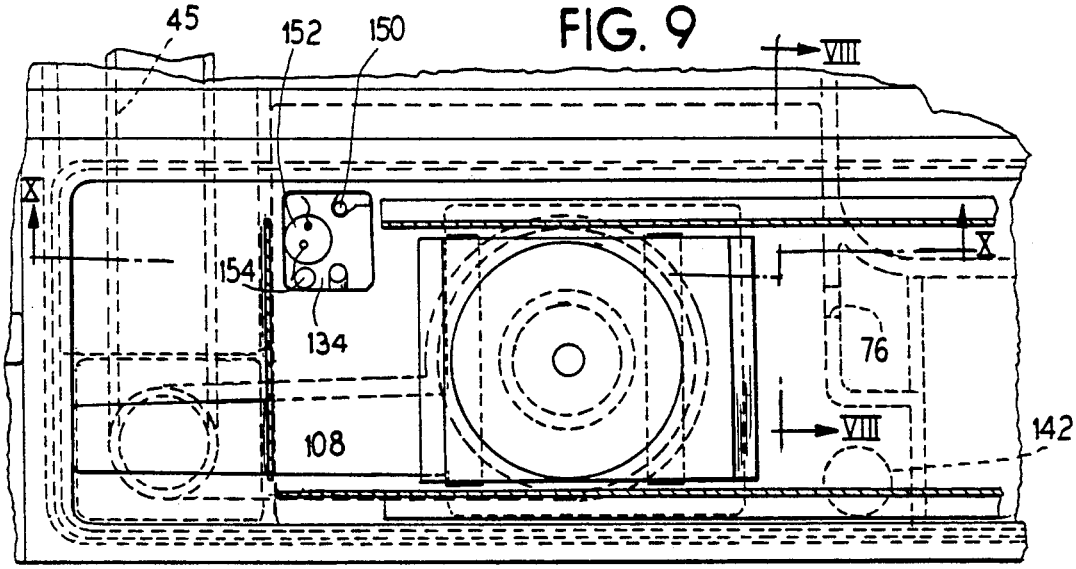
FIG. 9 is a top sectional view of the electrical module taken generally along the line IX—IX of FIG. 4.
Figure 10:
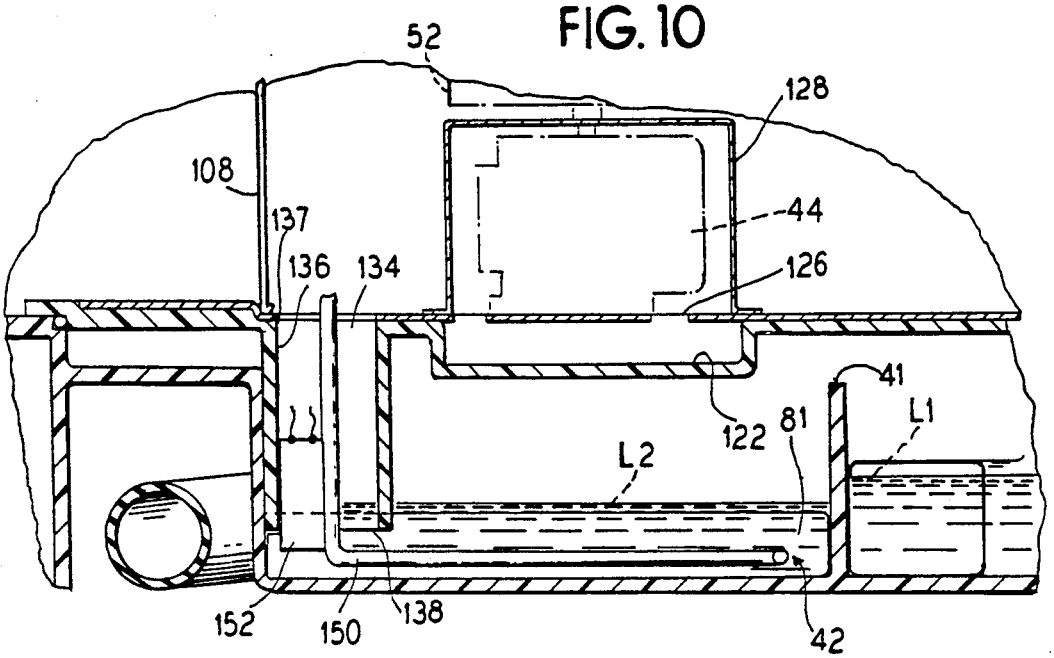
FIG. 10 is a side sectional view of the spray sump taken generally along the line X—X of FIG. 9.

Two air outlets are provided for the pressurized air. A first outlet 132 is one or more small vent openings in the cover 108 leading back into the area enclosed by the dishwasher cabinet 12. A second outlet 134 (FIGS. 9, 10) leads to the washing chamber 16; however, this outlet is designed so that no air can flow through the washing compartment 16 when the machine is operating in a wash or rinse mode. This is accomplished by providing an air duct 136 having an inlet opening 137 open to the interior of the cover 108 and an outlet opening 138 open to the spray sump 42. The outlet opening 138 to the spray sump 42 is covered by wash (or rinse) liquid at level L2 or higher when the machine is in the wash (or rinse) mode of operation.

When the liquid is pumped out of the sumps 38, 42, the liquid level therein drops below the outlet opening 138, thus permitting air from the interior of the housing 108 to flow through the air duct 136. Since the outlet opening 138 provides a larger cross-sectional area for air flow than the first outlet 132, most of the air flow generated by the fan 52 passes through the air duct 136 and into the spray sump 42. From the spray sump 42, the air flows directly into the washing chamber 16 through the channel 48 and through the screen 72, thus drying the screen. Further, since the motor 44 that runs the fan 52 also runs the pump 43, air will be pumped through the spray arm 20 and will therefore dry out the interior of the spray arm.

Air control through the wash chamber 16 is needed since it is undesirable to have air flowing through the dishwasher during washing and rinsing. Excessive moisture and heat losses would occur should pressurized air be introduced into the wash cavity during the wash or rinse mode. When the machine is washing or rinsing, the spray pump fan 52 still provides cooling air for the pump motor 44. The air path through the wash chamber (drying air) presents significantly lower resistance to airflow than the vent openings in the cover 108; hence the air path through the wash chamber is the principal path used when the machine contains no wash liquid.

Figure 4:
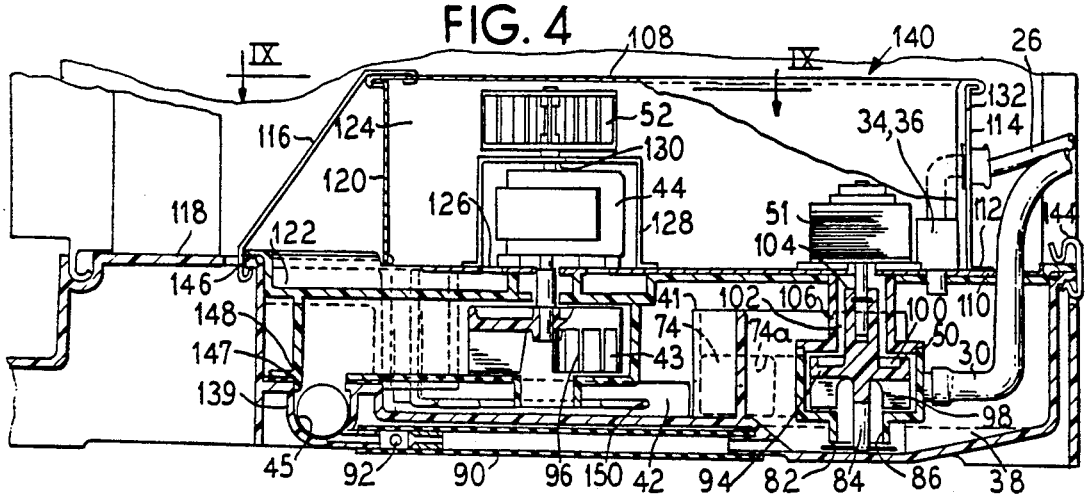
FIG. 4 is a side sectional view of the sumps and pumps area taken generally along the line IV—IV of FIG. 3.

In order to reduce manufacturing costs, the dishwasher may be constructed in a modular fashion with many of the structural components molded as a unit. For example, the washing compartment may be molded as a single unit. Also a molded base unit 139 may be provided which contains both the settling chamber/-drain sump 38 and the spray sump 42 as well as the above described walls 75, 41. A power module 140 (carried on the subassembly base 110) may be provided which carries the drain pump 50 and its motor 51, the spray pump 43, its motor 44, and the fan 52, as well as other components such as an overfill protect float 142 (FIGS. 3 and 9) and fill valve 34 and vacuum break 36 (FIG. 4). The power module 140 can be assembled onto the base unit 120 by a minimum of fasteners, such as a clip 144 and the connecting rod 116 with a seal 146 being provided between the two units. A seal member 147 is also provided where an outlet 148 of the spray pump 43 joins the connecting conduit 45 leading to the spray arm 20.

The spray pump 43, located at the front of the power module 140, is centered in the spray sump 42 molded in the base unit 139. The pump 43 is surrounded by a tubular electrical heating element 150. The heating element 150 is formed in a simple geometric shape to heat fluid throughout the sump 42, and is carefully located so that it is spaced away from direct contact with any of the molded plastic parts of the system. In the exemplary embodiment, heating element power is 1200 watts and provides a temperature rise of about 3° fahrenheit per minute. The spray pump flow rate is approximately eight gallons per minute.

The control system may either be electronic or electromechanical. In the illustrated embodiment, the control is designed for a timed- fill with a float switch overfill protection. The control is designed to be a complete subassembly located at the dishwasher front to the right of the washing compartment 16. The control provides a temperature hold on selected parts of the cycle. A 140° fahrenheit temperature hold thermostat 152 is installed in the machine power module along with a second safety thermostat 154 that shuts off the water heater element 150 in the event of an over-temperature condition. The safety thermostat 154 operates independently of the control module.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In a dishwasher having a wall defining a wash cavity, spray means for distributing wash liquid within said wash cavity, and drain means located within said wash cavity for draining wash liquid from said wash cavity, a wash system comprising:

first sump means for collecting at least a portion of said wash liquid, a first slightly downwardly sloped solid bottom walled channel with substantially vertical side walls leading from said drain means to said first sump means, first pump means for providing pressurized wash liquid to said spray means from said first sump means, second sump means for collecting the remaining portion of said wash liquid, a second slightly downwardly sloped solid bottom walled channel with substantially vertical side walls leading from said drain means to said second sump means, and second pump means for pumping wash liquid from said second sump means outside of said dishwasher.

2. A wash system according to claim 1, wherein said second sump comprises means for removing soils from said wash liquid.

3. A wash system according to claim 2, further comprising screen means on said drain means for directing soils into said second sump.

4. A wash system according to claim 3, wherein said spray means includes means for spraying said screen means to assist in directing said soils into said second sump.

5. A wash system according to claim 1, wherein said second sump communicates with said first sump.

6. A wash system according to claim 1, wherein said first pump means comprises a relatively large capacity pump and said second pump means comprises a relatively small capacity pump.

7. A wash system according to claim 1, wherein said second pump means comprises a motor, a pump shaft driven by said motor, a pump intake, a portion of said pump shaft extending through said pump intake into said second sump means, and a chopper wire extending radially from said portion of said pump shaft extending into said second sump means, whereby said chopper wire operates within said second sump means during operation of said second pump means.

8. A wash system according to claim 1, wherein at least one of said pump means includes a motor, a pump shaft driven by said motor, and an impeller mounted on said pump shaft, said impeller having means for preventing flow of water along the pump shaft, a pump intake extending into at least one of said sump means, said motor being disposed over said sump, whereby sealless operation of said pump shaft is permitted.

9. A dishwasher comprising:

a wall defining a wash cavity;

spray means for distributing wash liquid within said wash cavity;

drain means located within said wash cavity having two separate outlets for draining wash liquid from said wash cavity;

first sump means for collecting at least a portion of said wash liquid from a first of said outlets of said drain means;

first pump means with a relatively high capacity for providing pressurized wash liquid to said spray means from said first sump means;

second sump means for collecting the remaining portion of said wash liquid from a second of said outlets of said drain means; and second pump means with a relatively low capacity for pumping wash liquid from said second sump means outside of said dishwasher;

said drain means comprising separate slightly downwardly sloped channels with substantially vertical side walls leading from said wash cavity to said first and second sump means.

10. A wash system according to claim 9, wherein said second sump comprises means for removing soils from said wash liquid.

11. A wash system according to claim 10, further comprising screen means on said drain means for directing soils into said second sump.

12. A wash system according to claim 11, wherein said spray means includes means for spraying said screen means to assist in directing said soils into said second sump.

13. A wash system according to claim 9, wherein said second sump communicates with said first sump.

14. A wash system according to claim 9, wherein said second pump means comprises a motor, a pump shaft drive by said motor, a pump intake, a portion of said pump shaft extending through said pump intake into said second sump means, and a chopper wire extending radially from said portion of said pump shaft extending into said second sump means, whereby said chopper wire operates within said second sump means during operation of said second pump means.

15. A wash system according to claim 9, wherein at least one of said pump means includes a motor, a pump shaft driven by said motor, and an impeller mounted on said pump shaft, said impeller having means for preventing flow of water along the pump shaft, a pump intake extending into at least one of said sump means, said motor being disposed over said sump, whereby sealless operation of said pump shaft is permitted.

16. A washer having a wall defining a wash chamber for receiving soiled articled to cleansed, comprising:

pump means for generating a recirculating flow or wash liquid in said wash chamber to remove soil particles from said articles;

means for dividing said recirculating flow of wash liquid on its return to said pump means into a relatively high volume flow stream and a relatively low volume flow stream;

first sump means for collecting said high volume flow stream;

second sump means for collecting said low volume flow stream; and second pump means for pumping wash liquid from said second sump means outside of said dishwasher;

said second sump means including soil separating means comprising walls positioned to retain heavier and lighter than water soils in said second sump while permitting said wash liquid to flow from said second sump into said first sump.

17. A washer according to claim 16, wherein said means for dividing comprises two separate channels formed in said wash chamber.

18. A wash system according to claim 16, wherein said second sump communicates with said first sump.

19. A wash system according to claim 16, wherein said first pump means comprises a relatively large capacity pump and said second pump means comprises a relatively small capacity pump.

20. In a dishwasher having a wall defining a wash cavity, spray means for distributing wash liquid within said wash cavity, and drain means located within said wash cavity for draining wash liquid from said wash cavity, a wash system comprising:

first sump means for collecting at least a portion of said wash liquid, first pump means for providing pressurized wash liquid to said spray means from said first sump means, second sump means for collecting the remaining portion of said wash liquid, second pump means for pumping wash liquid from said second sump means outside of said dishwasher, and means for preventing the flow of wash liquid from said first sump into said second sump, yet permitting the flow of wash liquid from said second sump into said first sump.

* * * * *